US007677401B2

(12) United States Patent
Rudy

(10) Patent No.: US 7,677,401 B2
(45) Date of Patent: Mar. 16, 2010

(54) LOAD MONITORING AND CONTROL SYSTEM WITH SELECTIVE BOOM-UP LOCKOUT

(75) Inventor: John R. Rudy, Greencastle, PA (US)

(73) Assignee: Manitowoc Crane Companies, Inc., Reno, NV (US)

( * ) Notice: Subject to any disclaimer, the term of this patent is extended or adjusted under 35 U.S.C. 154(b) by 0 days.

(21) Appl. No.: 12/219,112

(22) Filed: Jul. 16, 2008

(65) Prior Publication Data

US 2010/0012610 A1 Jan. 21, 2010

(51) Int. Cl.
*B66C 13/23* (2006.01)

(52) U.S. Cl. ..... 212/270; 212/276; 212/278

(58) Field of Classification Search ..... 212/270, 212/276, 278

See application file for complete search history.

(56) References Cited

U.S. PATENT DOCUMENTS 3,540,271 A * 11/1970 Hoff ..... 73/862.41
3,638,211 A 1/1972 Sanchez
4,395,706 A * 7/1983 Garber ..... 340/685
5,645,181 A 7/1997 Ichiba et al.
5,823,370 A * 10/1998 Ueda ..... 212/276
6,744,372 B1 6/2004 Shaw et al.
6,994,223 B1 * 2/2006 Edgar et al. ..... 212/270

FOREIGN PATENT DOCUMENTS

EP 0 353 099 A2 1/1990
EP 0 487 725 A1 * 6/1992
EP 0 614 845 A2 9/1994
EP 0 994 065 A1 4/2000
JP 2000-255980 A * 9/2000
WO WO-97/29038 A1 8/1997

* cited by examiner

*Primary Examiner*—Thomas J Brahan
(74) *Attorney, Agent, or Firm*—Birch, Stewart, Kolasch & Birch LLP

(57) ABSTRACT

A method is disclosed for controlling a crane which comprises a boom that may be raised or lowered by angular adjustment of the boom about a base portion of the crane. The method prevents operation of the crane in an undesired condition by continuously monitoring operation of the crane, including monitoring at least the position of the boom with respect to the base of the crane. If the crane approaches a limit of its operating range or any operational parameter, its operation will be controlled so as to selectively prohibit or permit a boom raising operation of the crane, depending on the cause of the condition, rather than uniformly prohibit such an operation.

16 Claims, 4 Drawing Sheets

LOAD MONITORING AND CONTROL SYSTEM WITH SELECTIVE BOOM-UP LOCKOUT

Systems that monitor loads on a crane and control the crane in accordance with sensed conditions, and components of such systems, are referred to by various terms. These include Load Moment Limiters, Rated Capacity Indicators, Rated Capacity Limiters, Load Indicators, Safe Load Indicators, Load Moment Indicators, etc. Each of these may be a system, or part of a system that monitors loads on a crane in order to assist an operator to operate the crane only within recommended or desired parameters. For the sake of brevity, all such systems will be referred to hereinafter as Load Moment Indicator (LMI) systems.

Typically, an LMI system receives data indicating the configuration of the crane, including such factors as boom length, boom angle, configuration and dimensions of the outriggers or other supporting base for the crane, mass and position of counterweights, etc. The LMI further monitors the load on a crane at each instant of time. For each configuration of the crane there will be appropriate capacity limitations including some maximum permissible load which can be lifted or supported by the crane, and a varying limit on the permissible range of movement of the crane and its load for loads of varying magnitudes. The set of parameters and/or limits applicable to operation of a crane in a given configuration is commonly known as the "capacity chart" for the crane in such configuration. Obviously, the maximum permissible load and range of movement will vary with the configuration of the crane, and data representing the various corresponding "capacity charts" will be incorporated into the controller of the crane to provide appropriate references in determining, at all times, if the crane is operating within desired limits or ranges. The LMI system is programmed to restrain or prevent operation of the crane in one or more ways if an undesired condition is detected, such as when the crane is nearing a limit to its desirable operational range.

A typical undesirable crane operation is when an operator attempts to raise a grounded load (a load resting on the ground or some other support) that is too heavy. The load may be "too heavy" because the mass of the load is too great in view of, for example, the length and position of the boom, the distance at which the load is positioned from the base of the crane, and the configuration and dimensions of the supporting base for the crane. In such a situation, an operator might consider attempting to remedy the situation by raising the boom of the crane (an operation often identified as "boom up" or "derrick in") to thereby move the load closer to the supporting base of the crane, thus reducing the forces that might tend to destabilize the crane.

Many cranes are not equipped with an LMI system which would prevent a boom up operation. Cranes that include an LMI system that would lock out a boom operation in such a situation would conventionally simply lock out the boom up in every such situation where there is an attempt to raise a "too heavy" load.

Despite the too heavy load, it may be desirable or necessary for an operator to, nevertheless, raise the boom even in such circumstances. An operator may choose to raise the boom, even with the heavy load, because of unusual operating conditions, because of an emergency situation, etc. Accordingly, LMI systems most typically include an override function which enables an operator to override or bypass an operational lockout. Thus, even if a boom up operation is locked out, an operator may choose to override the lock out and, nevertheless, raise the boom.

This conventional approach—locking out an undesirable operation when a crane is approaching an undesired configuration but permitting an operator to override—is satisfactory in some measure. However, it can have the drawback of conditioning operators to routinely and too often override lock out functions, thus developing what might be characterized as an override habit. That circumstance creates a danger that an operator will, too readily and/or too frequently override a function lock out without sufficient consideration when it may be undesirable to do so. Accordingly, it is not desirable to encourage or require a boom operator to override a function lock out too often or unnecessarily.

Thus, typically, prior art LMI systems sense that a crane may be approaching a certain type of maximum load condition and respond uniformly each time such a condition is identified. For example, the EN13000 standard employed generally in Europe would require that a boom up operation be prohibited (locked out) in the event of a situation as described above, that is, when the mass of a load supported by the crane is outside of a desired range of operation given the boom length, boom position, load position and dimensions and configuration of the support base for the crane. The EN13000 standard would require an operator to override the boom up lockout in the event that the operator, despite the circumstances, intended to raise the boom. An override by the operator would be required in every instance in which such operation was sensed, which may lead to an undesirable override habit as discussed above.

SUMMARY OF THE PRESENT INVENTION

The present invention results from a recognition of the fact that identical sensed conditions in operation of a crane may result from different circumstances or operations. The present invention is further based upon an appreciation of the fact that it may be desirable to selectively permit or prohibit a particular operation of a crane when a particular condition is sensed.

The invention provides a method for operating a crane, normally employing an LMI system, which prohibits an operation of a crane when a particular condition is sensed, but selectively permits an operator to execute the same crane operation in the same condition when that operation might alleviate the condition readily. Further, the method of the invention selectively permits the operator to execute such an operation without having to first execute an override or bypass operation. Thus, the method of the present invention does not contribute to an undesirable "override habit" on the part of an operator. Thus, if during operation of a crane a particular condition is sensed wherein the crane is nearing a limit of its intended or desired operational range, a method according to the present invention, and an LMI system in accordance with the present invention, would selectively enable an operator to execute a specific crane function when execution of the function would serve to efficiently return the crane to a configuration wherein the crane is again well within its desired limits of operation, but prohibit the same operation of the crane when such an operation would amount to little more than an undesirable attempt to circumvent the limitations imposed by the LMI system.

BRIEF DESCRIPTION OF THE DRAWINGS

The present invention will be best understood upon consideration of the following detailed description of a particular embodiment of the invention considered together with the accompanying drawings in which.

DETAILED DESCRIPTION OF A PREFERRED EMBODIMENT

Figure 1:
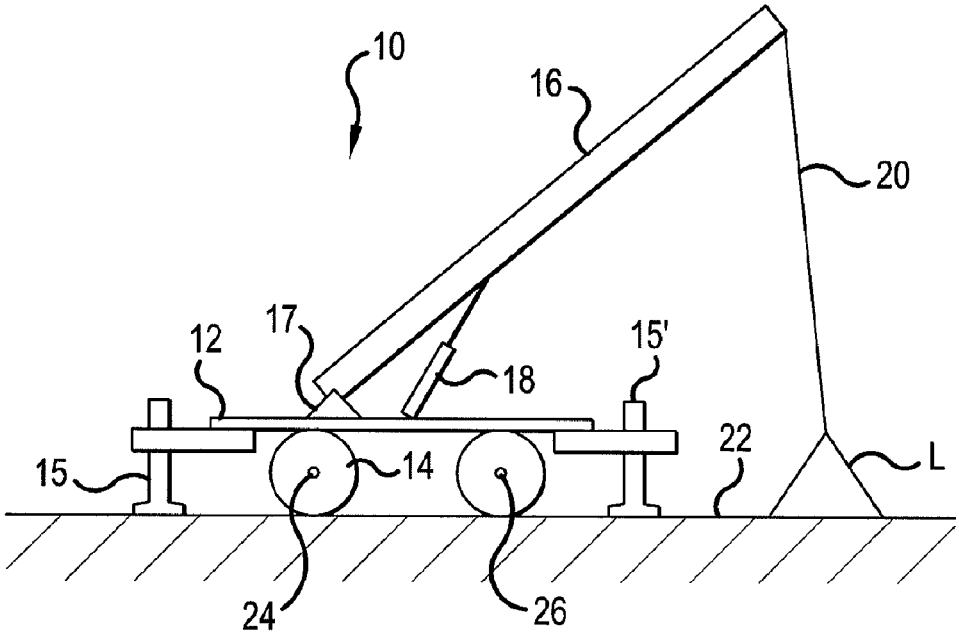
FIG. 1 is a schematic illustration of a crane lifting a load from a rest (grounded) position.

FIG. 1 schematically illustrates a crane 10. The crane comprises a base 12 typically supported on, for example, a pair of wheels 14. Various cranes may be supported upon tracked transport means. During lifting operations, many cranes employ, for example, outriggers 15, 15' for providing a wider and more stable support base for the crane, counterweights (not shown), etc. Other configurations of cranes are known, and the invention is not limited to the example schematically illustrated.

A crane typically includes a boom 16 which is pivotally connected to the base of the crane in the vicinity of point 17, and which may be raised and lowered by a lift cylinder 18. The cylinder 18 is operated by hydraulic means, as is well known. A cable 20 is provided for lifting loads, represented in FIG. 1 as L. A hook (not shown) is typically provided for engaging the load, which is raised and lowered by taking in and paying out cable 20 via a powered winch (not shown) in a well known manner.

Many cranes include a load moment indicator (LMI) system for controlling the operations of the crane and, particularly, for assuring that the crane is operated within a range of loads and other parameters for the particular configuration of the crane at any time. As noted above, an LMI system will typically receive data representing the configuration of the crane, including such factors as the boom length, configuration of the supporting base of the crane, mass and position of counterweights, etc. Data representing appropriate "capacity charts" is incorporated into the control circuitry or software of the LMI system to thus establish the desired operating parameters. The LMI system will further include sensors of various types to monitor movements of the crane and to determine the stress and load on the crane at various points, thereby determining operating conditions at any instant of time. Sensors may typically include a boom angle sensor, a boom length sensor, possibly a pressure sensor associated with the lift cylinder or a load pin associated with the boom tip sheave to indirectly measure the load on the hook, or a load cell associated with the hook to directly measure the load.

If a load on the crane is too great, or the position of a load is such that the crane is approaching a limit to its operational parameters based on the applicable data associated with the controller, the LMI will generally impose limitations on the manner in which the crane can be operated to thereby assure that the crane cannot be further operated in a manner that would put it outside such parameters. If the limits are approached, the LMI system will normally respond by preventing ("locking out") operation of a crane in a manner which will cause the crane to more closely approach the limit of operation.

FIG. 1 illustrates a crane poised to, perhaps, lift load L from the ground 22. Upon any attempt to lift the load, by taking up cable 20 or by raising boom 16 via lift cylinder 18, the mass and position of load L could be sufficient to destabilize the crane, perhaps causing the crane to tip over. An LMI system might attempt to sense when the crane approaches such a condition in various ways. For example, sensors associated with axles 24 and 26 of the crane might determine that there is a relatively great load on axle 26 and a relatively small load on axle 24, indicating that the crane is experiencing a load that, if increased, may tend to tip the crane forward. If outriggers 15, 15' are employed, sensors might determine the relative loads on outriggers 15 and 15', thus providing a similar indication. A pressure sensor associated with cylinder 18 might be used to measure the downward pressure on the boom and a determination may be made by the controller whether the pressure is excessive given the length of the boom and the existing configuration of the support base for the crane.

If it is determined that the crane is approaching an operational limit, the LMI would normally operate to lock out any function that would have the effect of permitting the crane to more closely approach that limit. In the situation described, the LMI system might lock out any further operations for taking up cable 20 or for raising boom 16. Prohibiting take up of cable 20 prevents an operator from proceeding with further efforts to lift the load by reeling in cable 20. An operator might attempt to reduce the moment imposed on the crane by raising boom 16. Raising boom 16 would tend to bring load L to a position closer to the base of the crane. That would reduce the forces and moments which might tend to destabilize or tip the crane.

However, in the circumstances described—an attempt to lift a grounded load—raising the boom in this manner is normally ill-advised, and should be routinely prohibited. An override function may be provided as discussed above, to enable an operator to execute the boom up operation in the event of an emergency or other unusual operating condition. However, prohibiting the boom up operation in these circumstances is normally desirable.

Figure 2:
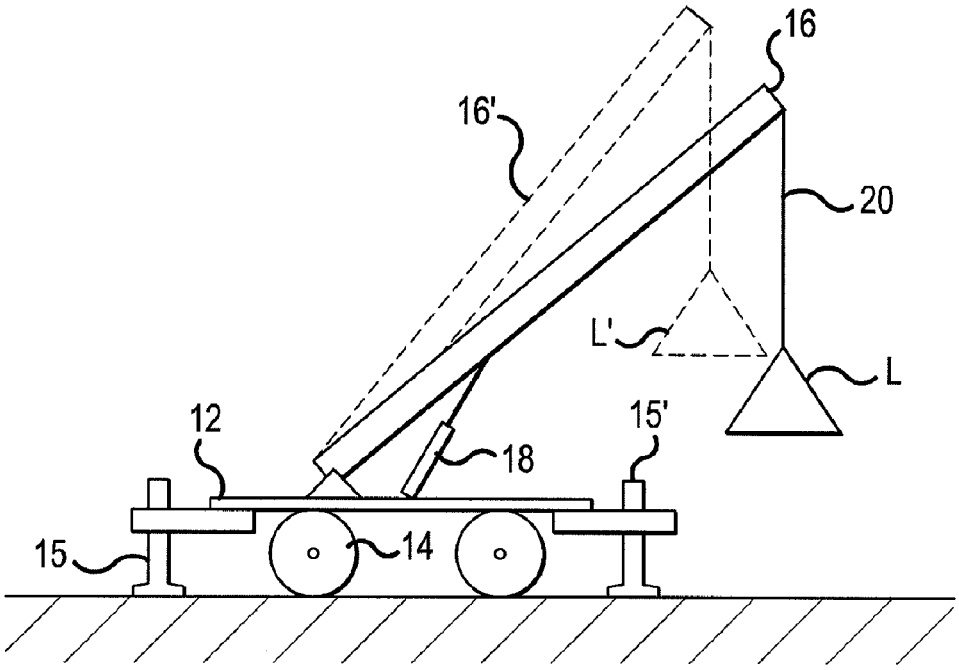
FIG. 2 is a schematic illustration of a crane supporting a load in a suspended position.

FIG. 2 schematically depicts a crane, substantially similar to the crane in FIG. 1, wherein the load L is suspended by cable 20 at some distance spaced laterally from the support base of the crane. If the mass and position of load L are within normal operating parameters for the crane, operation will proceed normally and all crane functions will be permitted.

However, if load L is so great, or if it is positioned laterally so far from the support base of the crane that the crane is approaching an operational limit, an LMI system, conventionally, will respond in the same manner, locking out functions that would tend to bring the crane closer to such limit. Thus, the functions of taking up cable 20 to lift load L, and raising boom 16 to lift the load, would be locked out by the LMI. This may or may not be precisely what should be done in the circumstances.

For example, perhaps in the process of raising the load L, the load became snagged on some stationary object. When the load is snagged, any raising of the boom or any reeling in of cable 20 will meet with increased resistance, resulting in the crane approaching an operational limit. In that situation, it would be appropriate and desirable to lock out any further raising of the load, either by raising the boom or by taking up more cable.

Suppose, however, that boom 16 supporting load L was initially at a position identified as 16' in dashed lines in FIG. 2. Subsequently, perhaps, the boom might have been lowered to the position shown in full lines in FIG. 2. As a result, load L was moved to a position which is laterally further away from the support base of the crane. As a result, if the mass of load L is sufficiently great, the forces imposed by the load at the more extended position could then bring about a situation wherein the crane is nearing the limit of its capacity to support such a load. Stated differently, the crane would be nearing the limit of the distance from the base of the crane at which it could support a load of the magnitude on the hook at that moment. The condition sensed by the LMI in this situation is the same condition sensed by the LMI in the circumstances described with respect to FIG. 1, and the same as the condition sensed upon snagging of the load on a stationary object, as described above. In a conventional LMI system, the result would be the same—the boom up function and the function of taking up more cable would be locked out.

However, in this situation, described with respect to FIG. 2, where the lowering of boom 16 was the cause of the crane approaching a limit to its desired range of operation, it is sensible, even desirable, to permit the operator to simply reverse the operation, raise the boom, and thus alleviate the condition. In accordance with the present invention, as described in greater detail below, in the circumstances described with respect to FIG. 2 the operator should be permitted to reverse the operation, raise boom 16 (which would have the effect of returning load L to the earlier position where the crane is well within its operational parameters) and thus eliminate the condition.

In accordance with prior known LMI systems, an operator might accomplish this by first overriding or bypassing the lockout of the boom up function. That is undesirable for at least two reasons. First, it delays the time which the operator could effectively relieve the sensed condition by raising the boom to its previous position. Second, permitting the operator to implement a desirable operation only after first exercising an override function contributes to an undesirable override habit, as discussed above. It is more suitable and desirable to permit an operator to execute desirable functions without having to override system controls, but to require an operator to exercise an override or bypass function in other circumstances wherein the operator should be consciously aware of any decision to execute a function or procedure which, possibly, could create a situation wherein the crane is operating outside of the limits defined by the data in the controller.

Known methods of operation or control of a crane do not distinguish between situations as described above—identical sensed conditions which call for distinctly different subsequent measures. The present invention provides a method for operating and controlling a crane to selectively permit or prohibit particular operations in a condition wherein a crane is approaching a designated limit of a desired operational range depending upon the actual cause of the condition.

Figure 3:
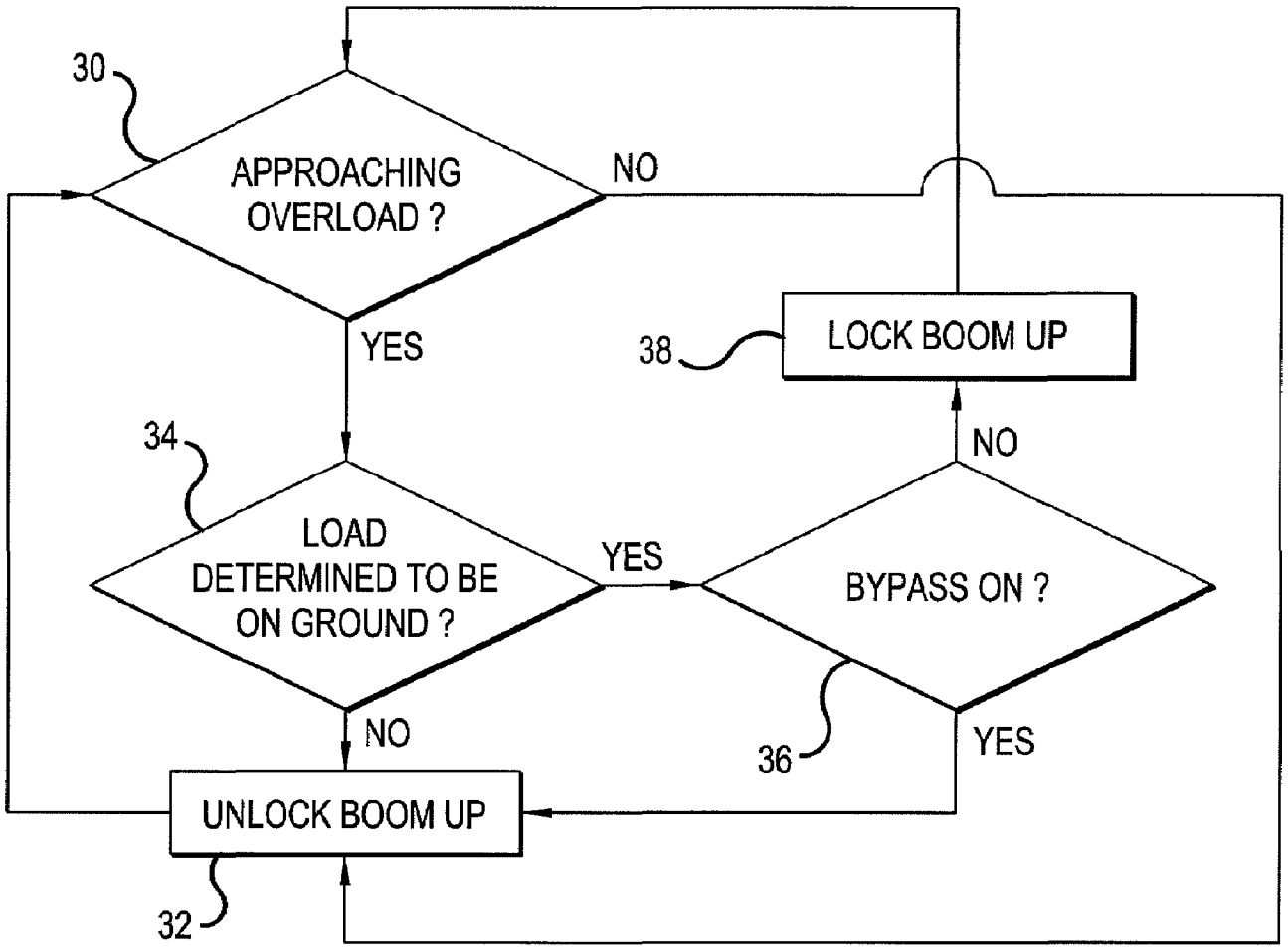
FIG. 3 is a flow or logic diagram explaining a method of operating a crane in accordance with the present invention.

FIG. 3 is a logic flow diagram describing generally a method according to the present invention for operating a crane. During operation, as represented at step 30, an LMI system associated with a crane continuously monitors operation of the crane for determining if the crane is nearing a configuration wherein it is approaching a limit to its designated operational parameters. This is identified in the flow diagram in shorthand as determining if the crane is "Approaching Overload." In the crane embodiment schematically shown in FIGS. 1-2, monitors might be provided for determining the respective support loads at points 24 and 26 (or at support outriggers 15, 15' or other points of support or stabilization, if present). Monitors would typically be provided for determining the configuration of the crane, mass and position of counterweights, the length and angle of boom 16, the load on cable 20, and other factors which may indicate that the crane is operating within normal parameters or, alternately, that it is approaching a limit to those parameters. If sensors indicate that the crane is within normal operating ranges, (i.e., no "overload") raising of boom 16 (the boom up function) is permitted as indicated at step 32.

If, on the other hand, the crane is nearing a limit to its operational range, a normal response of an LMI controller would be to lock out such functions as boom up. In accordance with the present invention, however, it is first determined if the condition is the result of an attempt to raise a grounded load, as indicated at step 34. If the operation causing the condition is an attempt to raise a grounded load, the LMI system will lock out the boom up operation, as indicated at step 38 in FIG. 3, assuming that the operator has not exercised an override or bypass function. A determination will be made as to whether the bypass or override function is engaged, as indicated at step 36. If the bypass function has not been engaged by the operator, then the boom up function will be locked out, as indicated at step 38. If the operator determines that the boom up function is desired despite the sensed condition, the bypass function may be engaged and the boom up function will be permitted, as indicated at step 32.

The result is that a method of operation of a crane in accordance with the present invention will selectively permit or prohibit a boom up operation in the event of a sensed condition that would normally result in that function being prohibited by the controller. This promotes efficient operation of the crane, without encouraging or fostering an override habit on the part of a crane operator.

Figure 4:
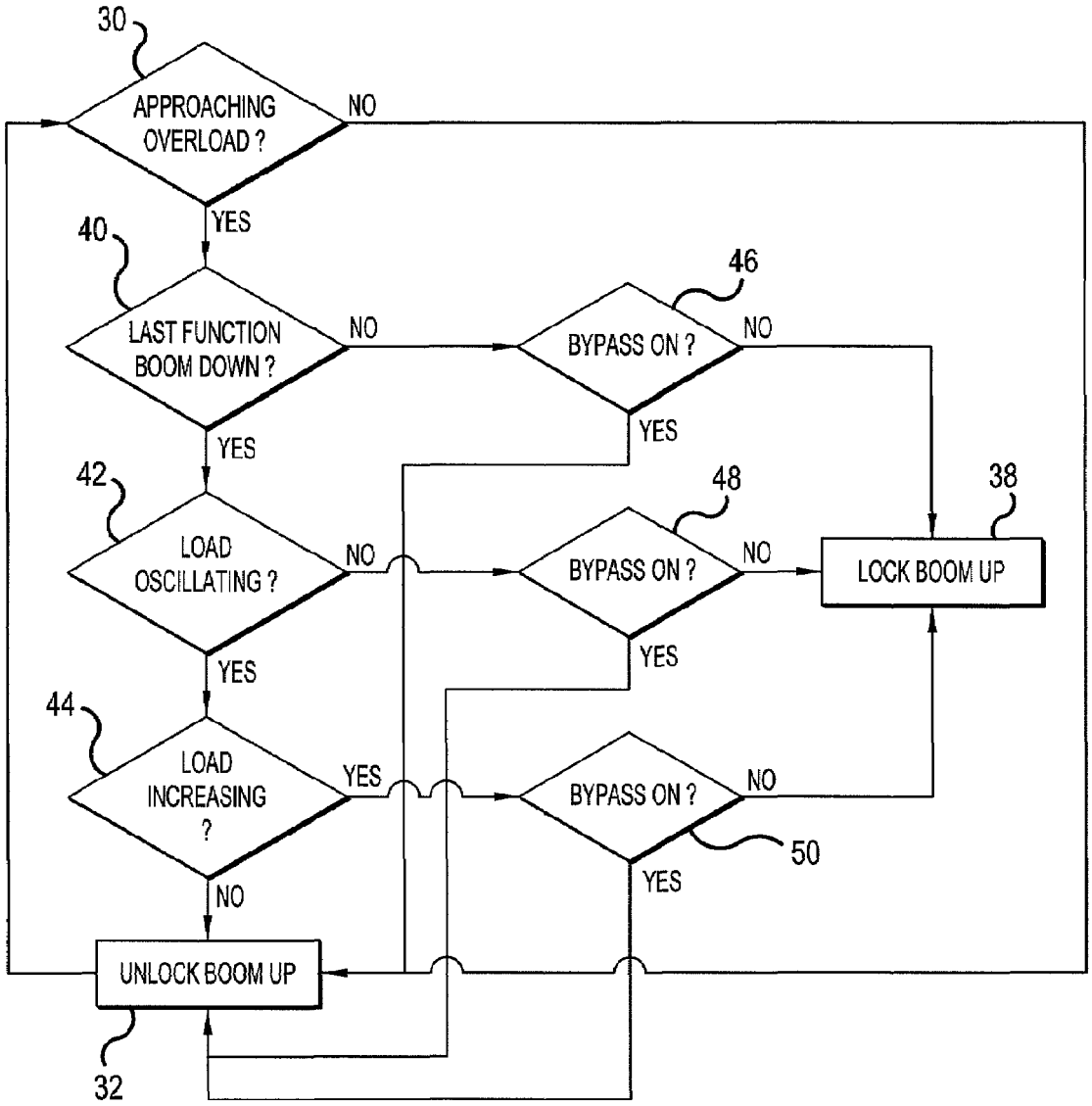
FIG. 4 is a more detailed flow or logic diagram for explaining a method in accordance with the present invention.

FIG. 4 depicts in greater detail the method of operation of the crane in accordance with the present invention. As discussed above, at step 30, operation of the crane is continuously monitored for conditions wherein the crane is approaching a limit to its range of desired operation. If no such condition is detected, then a boom up operation is permitted, as indicated at step 32.

If such as condition is detected, in accordance with the present invention a determination is made as to the cause of the condition. At step 40, a determination is made if the last function of the crane, performed immediately prior to detecting the condition, was a boom down operation (lowering of the boom). This could be determined, for example, by continuous reading of a boom angle sensor associated with the crane, by a sensor associated with the controller for boom up and boom down operations, or any other sensor or combination of sensors for identifying or indicating actual boom position or changes in boom position.

If a determination is made at step 40 that the last function was boom down, then a further determination is made as to whether the load is oscillating, as indicated at step 42. This may be accomplished for example, via motion sensors associated with the load, with the load hook, with cable 20 or any other suitable means for indicating that there is movement of the load. If the load is oscillating or otherwise moving, then it is not resting on the ground or other surface.

If a determination is made that the load is oscillating, then a further determination is made at step 44, as to whether the load on the crane is increasing. This can be determined by, for example, strain gauges or other sensors associated with cable 20, associated with a hook supporting the load, by force or power sensors associated with the reel or drum (not shown) for taking up cable 20, by gauges associated with the boom structure, or any other suitable means. If the load is increasing, that serves as an indication that there is an ongoing attempt to raise a load that is grounded. The absence of any substantial change in the load is an indication that the load is already suspended by the crane.

In these circumstances, wherein the last function was boom down, the load is oscillating or moving, and the load is not increasing, it can be safely inferred that the sensed condition is the result of the boom down function. In that event, it is desirable to permit the operator to execute a boom up function, to reverse course and relieve the condition, thus assuring that the crane remains within desired limits of operation. It is desirable to do so without requiring the operator to execute an override function, thus possibly delaying an operation which could achieve that desirable result. Thus, in accordance with the present invention, a boom up operation will be permitted as indicated at step 32 in FIG. 4.

If the above described conditions are not satisfied, then a normal course of operation would be to lock out a boom up operation, as indicated at step 38, when it is detected that the crane is nearing an operational limit. At step 40, if the last function was not a boom down operation, or if the load is not oscillating as determined at step 42, or if the load is increasing as determined at step 44, then the boom up operation will be locked out, as indicated at step 38, in order to prevent an operator from executing such an operation which would normally be ill-advised in those circumstances. In each instance, a determination is first made as to whether the operator has consciously and deliberately executed a bypass or override operation, as indicated at steps 46, 48 and 50, respectively. If the override has not been engaged, then boom up will remain locked out. If an operator has consciously determined to raise the boom despite the sensed condition, and has engaged the by-pass function, then the boom up function will be permitted as indicated at step 32.

Figure 5:
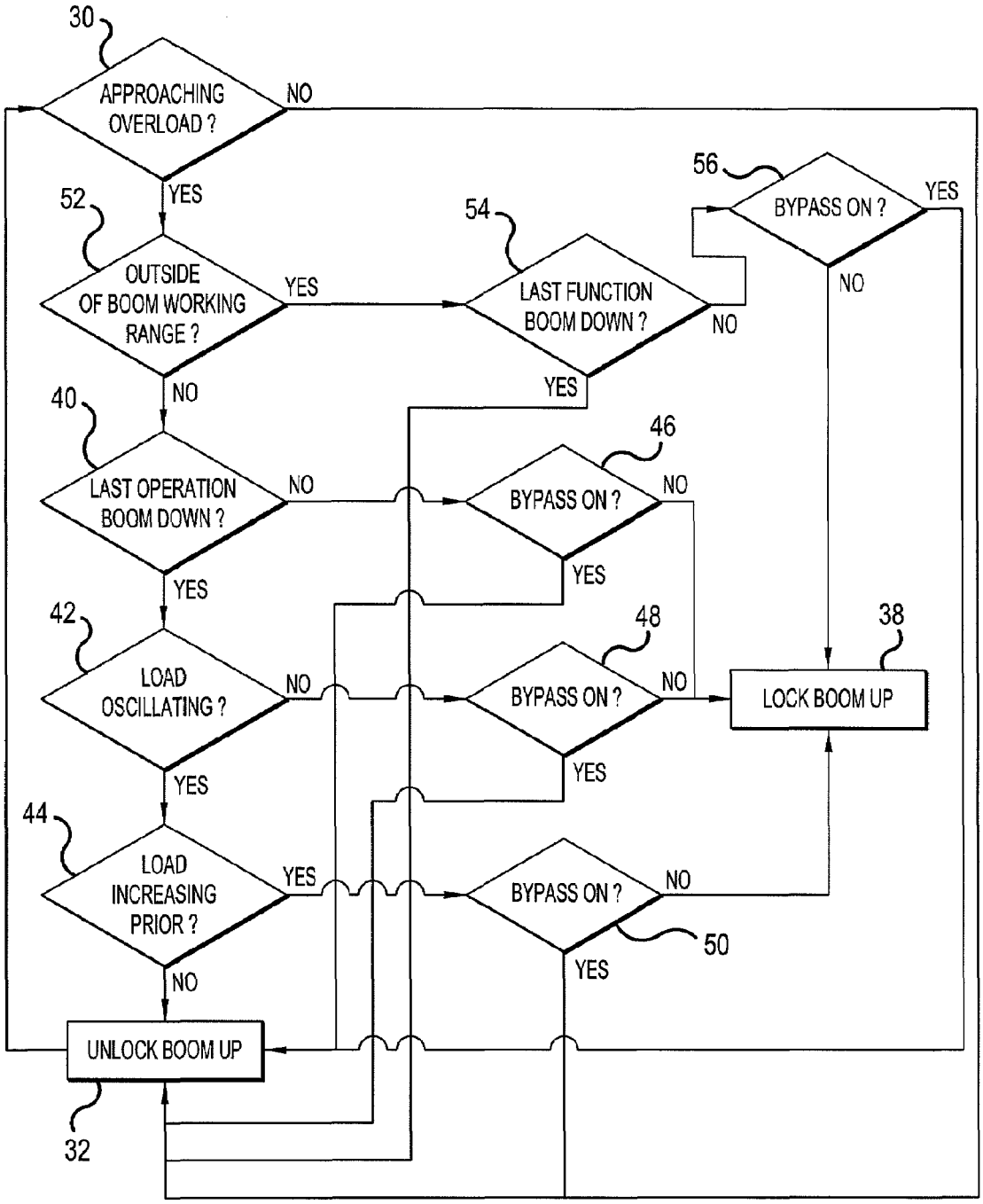
FIG. 5 is another flow or logic diagram for explaining an additional aspect of the present invention.

The discussion above has been directed toward situations wherein a crane is nearing an operational limit because of a load on the hook. However, it can be appreciated that this type of situation can occur without a load on the hook. In many crane configurations the allowed load capacity at low boom angles is very small. Indeed, it occurs in some cranes and for certain crane configurations that, below a certain minimum boom angle, the allowed load capacity is zero because the mass of the boom is itself sufficient to cause the crane to approach its limit of operational range. If the operator booms down to an impermissibly low boom angle, the LMI system controller would lock out the boom functions even though there is no load on the hook. The invention contemplates and addresses this situation. FIG. 5 is an additional flow logic diagram that explains the operation of the present invention, including this last-described situation.

Portions of FIG. 5 corresponding to FIGS. 3 and 4 are similarly numbered and identified. Those aspects of the invention function in the same manner as described above with reference to FIG. 4 and FIG. 3, and will not be again described.

As discussed above, at step 30 a determination is made as to whether the crane, in operation, is approaching a limit to its desired operational range. If so, then another determination is made at step 52 whether the boom of the crane is outside of its desired operational range, i.e., if the boom is below a minimum boom angle for the instant crane configuration. If it is outside the desired range, then the next step might conventionally be to lock out boom functions. However, at Step 54 a determination is first made as to whether the last operation was boom down. If the last operation was boom down, then the controller of the LMI system in accordance with the invention will permit a boom up operation because to do so will enable an operator to promptly reverse course and bring the crane back toward a configuration wherein it is no longer approaching its operational limit. The operator can achieve this without any delay associates with engaging an override function, and without fostering an undesirable override habit, as discussed above.

In the other hand, if the last function was not a boom down operation, then the boom up function would normally be locked out, as indicated at step 38. However, a determination will first be made at step 56 as to whether the operator had engaged a bypass function. If not, then the boom up will remain locked out.

Thus, according to the present invention, a method for operating a crane and for controlling a crane comprises not only detecting an undesired condition, such as when a crane approaches a limit to its desired range of operation. The method of the present invention further involves the step of determining the cause of the condition. Depending upon the identified condition of the crane and its cause, operation of the crane is controlled so as to selectively permit or prohibit further operations of the crane depending upon whether such operations may be expected to quickly eliminate the undesired condition, on the one hand, or to cause the crane to more nearly approach or exceed a desired limit to its range of operation, on the other hand.

The present invention is not limited to the particular embodiments and methods shown and described, and is limited only by the scope of the following claims.

What is claimed is:

1. A method for controlling a crane to prevent operation of the crane in an undesired condition, said crane comprising a boom that may be raised or lowered by angular adjustment of the boom about a base portion of the crane, the method comprising monitoring parameters of operation of the crane, including monitoring at least the position of the boom with respect to a base portion of the crane;

selectively permitting an operator to execute a boom raising operation of the crane when the crane is in an undesired condition when the undesired condition was caused by a predetermined operation of the crane immediately prior to said condition; and blocking an operator from executing a boom raising operation of the crane when the crane is in the undesired condition when the undesired condition was not caused by a predetermined operation of the crane immediately prior to said condition.

2. A method for controlling a crane as in claim 1, wherein the crane is in an undesired condition as a result of the boom being in a position such that the load on the boom is at too great a radius from the base of the crane.

3. A method for controlling a crane as in claim 2, comprising permitting an operator to execute a boom raising operation if the undesired condition was caused by the boom being lowered immediately prior to said condition to thereby cause said condition.

4. A method for controlling a crane as in claim 3, further comprising prohibiting an operator from executing a boom raising operation if the undesired condition is caused by an attempt to raise a load that was not previously supported by the crane.

5. A method for controlling a crane as in claim 4, comprising the step of determining if said undesired condition results from an attempt to raise a grounded load.

6. A method for controlling a crane as in claim 4, comprising the step of determining if the load is oscillating when the undesired condition occurs.

7. A method for controlling a crane as in claim 6, further comprising permitting an operator to execute a boom raising operation when a determination is made that the load is oscillating when the undesired condition occurs.

8. A method for controlling a crane as in claim 4, comprising the step of determining if the load on the crane is increasing at the time the undesired condition occurs.

9. A method for controlling a crane as in claim 8, further comprising prohibiting an operator from executing a boom raising operation when a determination is made that the load is increasing when the undesired condition occurs.

10. A method for controlling a crane as in claim 3, further comprising prohibiting an operator from executing a boom raising operation if the undesired condition results from execution of any operation other than said predetermined operation immediately preceding the condition.

11. A method for controlling a crane as in claim 1, comprising permitting an operator to execute a boom raising operation when the undesired condition is a result of the boom being lowered to a position outside of a range of permissible boom positions for the configuration of the crane.

12. A method for controlling a crane as in claim 11, comprising prohibiting an operator from executing a boom raising operation when the undesired condition is not a result of the boom being lowered to a position outside of a range of permissible boom positions for the configuration of the crane.

13. A method for controlling a crane as in claim 1, comprising permitting an operator to execute a boom raising operation if the undesired condition was caused by performing both said predetermined operation of the crane and another operation of the crane simultaneously immediately prior to said condition to thereby cause said condition.

14. A method for controlling a crane as in claim 1, comprising permitting an operator to execute a boom raising operation if the undesired condition was caused by the boom being lowered immediately prior to said condition to thereby cause said condition.

15. A method for controlling a crane as in claim 14, comprising permitting an operator to execute a boom raising operation if the undesired condition was caused by the boom being lowered and another operation of the crane performed simultaneously immediately prior to said condition to thereby cause said condition.

16. A method for controlling a crane to prevent operation of the crane in an undesired condition, said crane comprising a boom that may be raised or lowered by angular adjustment of the boom about a base portion of the crane, the method comprising monitoring parameters of operation of the crane, including monitoring at least the position of the boom with respect to a base portion of the crane;

determining that the crane is in an undesired condition as a result of the boom being in a position such that the load on the boom is at too great a radius from the base of the crane; and selectively permitting an operator to execute a boom raising operation if the undesired condition was caused by the boom being lowered immediately prior to said condition to thereby cause said condition; and blocking an operator from executing a boom raising operation of the crane when the undesired condition was not caused by the boom being lowered immediately prior to said condition.

* * * * *